US010975669B2

(12) United States Patent
El Kholy et al.

(10) Patent No.: US 10,975,669 B2
(45) Date of Patent: Apr. 13, 2021

(54) OPTIMIZING WASTE SLURRY DISPOSAL IN FRACTURED INJECTION OPERATIONS

(71) Applicant: Advantek Waste Management Services, LLC, Houston, TX (US)

(72) Inventors: Sherif M. El Kholy, Houston, TX (US); Omar Abou-Sayed, Houston, TX (US); Ibrahim M. Mohamed, Houston, TX (US); Ahmed Abou-Sayed, Houston, TX (US)

(73) Assignee: Advantek Waste Management Services, LLC, Houston, TX (US)

( * ) Notice: Subject to any disclaimer, the term of this patent is extended or adjusted under 35 U.S.C. 154(b) by 0 days.

(21) Appl. No.: 16/623,386

(22) PCT Filed: Jun. 18, 2018

(86) PCT No.: PCT/US2018/038131
§ 371 (c)(1),
(2) Date: Dec. 16, 2019

(87) PCT Pub. No.: WO2018/232419
PCT Pub. Date: Dec. 20, 2018

(65) Prior Publication Data

US 2020/0182054 A1 Jun. 11, 2020

Related U.S. Application Data

(60) Provisional application No. 62/626,129, filed on Feb. 4, 2018, provisional application No. 62/558,806, filed
(Continued)

(51) Int. Cl.
*E21B 41/00* (2006.01)
*E21B 47/06* (2012.01)
(Continued)

(52) U.S. Cl.
CPC ..... *E21B 41/0092* (2013.01); *E21B 41/005* (2013.01); *E21B 41/0057* (2013.01);
(Continued)

(58) Field of Classification Search
CPC ..... E21B 41/005; E21B 43/26
See application file for complete search history.

(56) References Cited

U.S. PATENT DOCUMENTS 7,478,020 B2 1/2009 Guo
8,731,890 B2 5/2014 Fragachan
(Continued)

FOREIGN PATENT DOCUMENTS

WO WO2017069971 A1 4/2017

OTHER PUBLICATIONS

International Search Report and Written Opinion of the Examining Authority (KIPO) dated Aug. 11, 2018.
(Continued)

*Primary Examiner* — Robert E Fuller
*Assistant Examiner* — Lamia Quaim
(74) *Attorney, Agent, or Firm* — Peter V. Schroeder; Booth Albanesi Schroeder PLLC

(57) ABSTRACT

Methods and apparatus are provided for optimizing operations for a fracturing injection waste disposal well especially where the formation is damaged or tight such that pressure fall-off tests are impractical due to extended leak-off rate times. Formation closure pressure and formation stress are calculated using Instantaneous Shut-in Pressure rather than traditional methods requiring actual fracture closure.

24 Claims, 13 Drawing Sheets

Related U.S. Application Data on Sep. 14, 2017, provisional application No. 62/521, 226, filed on Jun. 16, 2017.

(51) Int. Cl.
*E21B 49/00* (2006.01)
*E21B 43/26* (2006.01)

(52) U.S. Cl.
CPC ..... *E21B 47/06* (2013.01); *E21B 49/008* (2013.01); *E21B 43/26* (2013.01)

(56) References Cited

U.S. PATENT DOCUMENTS

| | | | | |
|---|---|---|---|---|
| 2005/0216198 | A1 | 9/2005 | Craig | |
| 2010/0218941 | A1 | 9/2010 | Ramurthy | |
| 2010/0314104 | A1 | 12/2010 | Shokanov | |
| 2010/0332204 | A1* | 12/2010 | Fragachan | E21B 41/0057 703/6 |
| 2012/0158310 | A1 | 6/2012 | Adams | |
| 2014/0182844 | A1 | 7/2014 | Wutherich | |
| 2015/0039234 | A1 | 2/2015 | Abou-Sayed | |
| 2015/0075779 | A1 | 3/2015 | Walters et al. | |
| 2017/0152728 | A1 | 6/2017 | Abou-Sayed | |

OTHER PUBLICATIONS

ARMA 14-7759, A novel technique for assessment of fracture geometry and injection domain from falloff tests after fractured injection of slurry, M. Loloi, Jun. 2014.
ARMA/NARMS 04-547, Leak-Off Test Interpretation and Modeling with Application to Geomechanics, D. Lee, 2004.
ARMA/USRMS 05-676, Abou-Sayed, A.S., A geomechanics update on Alaska's GNI project, 2005.
SPE 102304, Application of New Fall-Off Test Interpretation Methodology to Fractured Water Injection Wells Offshore Sakhalin, P.J van den Hoek, 2006.
SPE 77946, Pressure Transient Analysis in Fractured Produced Water Injection Wells, P.J. van den Hoek, 2002.
SPE Reservoir Evaluation & Egr'g., Dimensions and Degree Containment of Waterflood-Induced Fractures from Pressure Transient Analysis, P.J. van den Hoek 2005.
SPE/IADC 79804 Ultimate Capacity of a Disposal Well in Drilling Waste Injection Operations, Ahmed Abou-Sayed, et al. 2003.
SPE14458, Fractured Water-Injection Wells a Pressure Falloff Test for Determining Fracture Dimensions, E.J. Koning 1985.

* cited by examiner

OPTIMIZING WASTE SLURRY DISPOSAL IN FRACTURED INJECTION OPERATIONS

FIELD

The disclosed methods and apparatus generally relate to design and conduct of waste disposal operations by hydraulic fracturing injection into a subterranean formation, and more particularly, to methods for maximizing formation disposal capacity and optimizing waste disposal operations.

BRIEF DESCRIPTION OF THE DRAWING

Drawings of the preferred embodiments of the present disclosure are attached hereto so that the embodiments of the present disclosure may be better and more fully understood:

FIG. 7A is a graph showing fracture closure pressure using G-Function Analysis during an early life stage of an injection well, when fracture closure occurs in a relatively short time period after shut-in;

DETAILED DESCRIPTION OF CERTAIN EMBODIMENTS

Waste Disposal by Hydraulic Fracturing Injection

Figure 1:
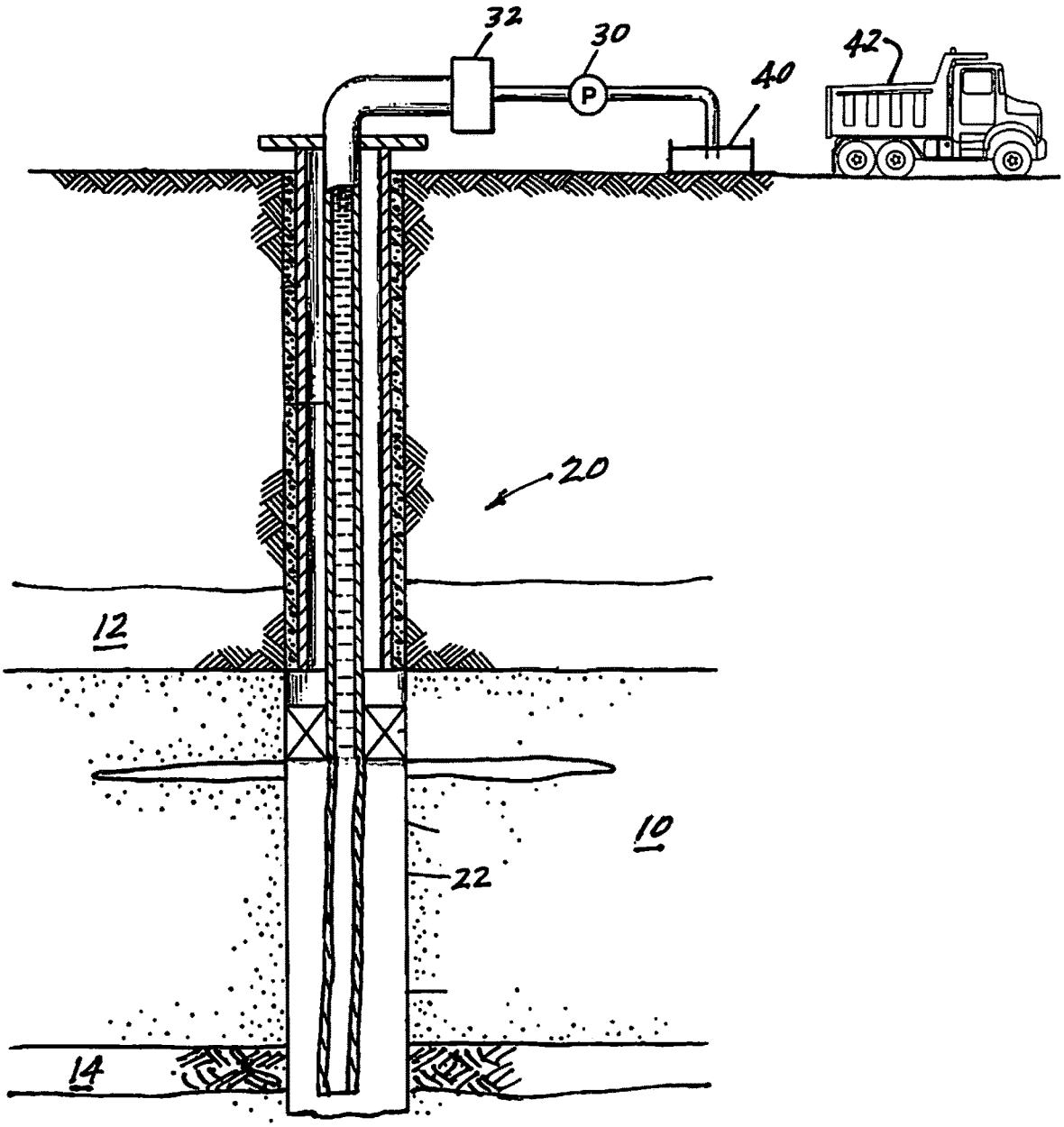
FIG. 1 is a schematic of an exemplary injection well disposal operation according to an embodiment of the disclosure herein.

Disposal of waste fluids by hydraulic fracturing injection into a target zone in a subterranean formation is well-known. FIG. 1 is a schematic of an exemplary injection well disposal operation.

Zones

A target zone 10 is typically confined by upper 12 and lower boundary zones 14. Waste disposal must occur in the target zone without breach of containment into the upper or lower boundary zones. A formation 16 may have multiple target zones layered between multiple boundary zones. Similarly, the formation may host several disposal wells. The zones, and particularly the target zone have associated petro-physical parameters which can be measured, calculated or determined as is known in the art. For example, a zone has an associated permeability, porosity, formation pore pressure, formation stresses, Young's modulus of elasticity, and Poisson's ratio. Further parameters can be used as well, such as overburden pressure, and toughness. Some parameters change over time or in response to well operations, such as borehole pressure, bottom hole pressure, formation pressure, formation or in situ stress, minimum horizontal stress, etc.

Disposal Wells

One or more disposal wells 20 have wellbores 22 extending through the targeted zone 10 or zones. A disposal well 20 may be a converted production well in a formation or zone depleted of its hydrocarbons or a dedicated disposal or injection well. The wellbore 22 is typically cased along at least a portion of its depth. One or more tubulars can be positioned in the wellbore and injection can occur through the tubulars or along the annulus between the wellbore and tubular.

Downhole tools, as is known in the art, can be employed during injection and hydraulic fracturing operations such as packers, seals, valves, screens, and measuring and sensing equipment (such as pressure sensors, bottom hole sensors, etc.). Measurement equipment can sense, record, and transmit data representative of temperature pressure, flow rate, acidity, etc., as measured at the surface, in the wellbore, at the bottom of the hole, etc. At issue here are pressure sensors for measuring or allowing calculation of formation pressure after shut-in of the well after waste fluid injection operations. Measurements may be made at downhole, wellbore, wellhead locations.

Pumping equipment, such as an injection pump 30 is positioned at the wellhead to pump waste fluids into the wellbore under pressure. Waste fluids or slurry are pumped into the wellbore into sub-surface fractures created by injecting the waste fluid or slurry under high pressure, higher than the formation fracture or breakdown pressure, into the disposal formation. Associated operational valving, controls, and safety valves are known in the art. A shut-in valve assembly 32 is provided to, when open, allow injection of fluid by pumping into the wellbore and formation. Shut-in occurs upon cessation of pumping.

Waste Fluids

Waste fluids 40 are injected into the target zone during disposal operations. Typically waste fluids 40 are prepared prior to disposal into a slurry, for waste slurry injection (WSI). Terms such as "waste fluids," "waste slurry," and the like are used interchangeably herein without limitation. Preparation can include sifting and screening, separation, grinding of particles, rheological treatment, addition of selected bacteria and organisms, dilution, dewatering and the like.

Waste fluids which can be disposed of by injection operations, and more specifically hydraulic fracturing injection operations, vary and include well operations waste fluids produced during exploration, drilling, completion, and production phases of oil and gas, such as drilling cuttings injection (DCI), fracturing operations waste fluids, and oil and gas waste injection fluids.

Other waste fluids can also be disposed of into subterranean zones, such as the by-products of sewage treatment processes, referred to generally herein as biosolid waste fluids. Sewage treatment typically passes through multiple treatment stages. For example, during primary treatment sewage is passed over screens to separate biosolids waste particles, called wetcake. In secondary treatment, bacteria in the sewage is digested, creating a digested sludge which can be separated. In tertiary treatment, sewage is further disinfected to consume bacteria, for example by adding chlorine. Waste fluid injection can be used to dispose of de-watered or diluted forms of sewage. Biosolid waste fluids subject to disposal can include biosolid wetcake, de-watered biosolids, biosolid digested sludge, and digested sludge.

Similarly, other wastes can be slurrified or otherwise prepared for disposal, such as radioactive waste material, waste organic materials such as food, contaminated fluids and solids, such as contaminated soil.

Waste fluids can be delivered to the injection site by pipeline or truck 42, from an on-site or off-site slurry or sewage facility, etc., as needed. The slurry can be held in storage tanks or conditioned.

Injection Operations: Cycles, Batches

Underground slurry injection for waste management is carried out in batches or cycles with intervening shut-in periods to allow fracture closure, pressure dissipation, and to prevent pressure accumulation and/or increase over the next batch cycles. Waste injection operations are long-term and periodic injections of solid laden slurries into a formation. It is not atypical for injection cycles to be carried out multiple times per day, multiple days per week, and over a period of months or years. In some cases, a single batch can take long periods to be injected, such as weeks.

Waste slurry is often injected intermittently in cycles or "batches." Batch injection consists of intermittently injecting slurry in cycles or batches between period of shut-in or rest. More informally, a batch may consist of a selected number of trucks or tanks where the slurry is delivered by such means.

A cycle or batch has known cycle parameters, such as batch volume, solids volume, solids concentration, viscosity, density, particle size, etc. The cycle parameters depend on the type of waste and slurry being injected and can be selected based on the physical and fractural properties of the formation.

Further, a cycle is injected by a pump with a known horsepower and pump curve under certain operational parameters, such as a pump rate, pumping duration (time), pump pressure, wellbore pressure, etc. For example, a batch injection duration can be minutes to weeks long.

During injection the zone is hydraulically fractured, creating and extending fractures through the formation. The waste fluid flows into the fractures and the waste solids are eventually trapped in and around the fractures when they close after cessation of pumping. Often, fracture is initiated hydraulically by clean water, then the waste slurry is injected downhole to fill and to propagate the initiated fracture. As cycles are repeatedly carried out, additional fractures are created, extended and filled. Over the course of the life of disposal formation operations, the parameters of the zone will change, damage will occur to the fracture faces, etc.

Shut-in

After each cycle, the well is shut-in at cessation of pumping. A period of rest follows. Cumulative rest of a formation is the summed rest periods over a given time period (e.g., a week) or number of cycles.

Upon shut-in, the disposal fractures close onto the disposed solids in the slurry and any build-up of pressure in the formation is dissipated. The waste fluid "leaks-off" after cessation of pumping, thereby reducing the formation pressure near the wellbore.

A shut-in or fall-off test is the measurement and analysis of pressure data taken after an injection well is shut-in. When the well is shut-in, pressure shut-in or fall-off data is collected. Pressure is measured over time to track the decrease in pressure after shut-in. Collection of such transient well-test data is well known in the art. Wellhead and bottom hole pressure rise during injection. If the well remains full of liquid after shut-in, the pressure can be measured at the surface and bottom hole pressure can be calculated. In some fracturing injection operations, the injection well goes into vacuum and the fluid level falls below the surface, so bottom hole pressure gauges or sonic devices can be employed. The term "test" does not imply that the injection procedure is performed only or primarily to take pressure drop-off or other measurements, although such tests are run under certain circumstances. Here, the shut-in or fall-off test is performed after an operational procedure, namely, fracturing injection of a batch of waste slurry.

Monitoring of the Formation

It is critical in disposal operations to contain disposed wastes in the target zone. Consequently, fracturing should not extend into the boundary zones. Further, slurry injection of large volumes must typically comply with governmental injection permit limits. A permit typically specifies a maximum allowable surface injection pressure (MASIP) and a maximum daily injected volume. Formation parameters, which change over the lifetime of a field, should be monitored.

Fracture Closure Pressure, Stress

Of major concern is continuous monitoring of fracture growth and the formation stress, which incrementally increases over multiple injection cycles, to ensure compliance and fracture containment. The injection of successive slurry cycles leads to incremental in-situ stress increase, resulting from the additional solid volume added into the injection zone over the well lifetime.

One of the key formation properties is the formation fracture pressure, which can be used to select the proper pump horsepower, pump rates, and other operational parameters for designing a hydraulic fracturing operation. Fracture closure pressure is the fluid pressure needed to initiate the opening of a fracture, and, after a fracturing operation, the pressure at which the fractures close. Closure pressure is equal to the minimum in-situ stress of the formation because the pressure required to open a fracture is the same as the pressure required to counteract the stress in the rock perpendicular to the fracture orientation.

Prior Art Methods for Determining Fracture Closure Pressure

In hydraulic fracturing applications, conventional pressure shut-in or fall-off pressure analyses are the main methods for predicting fracture closure pressure and formation stress. Fracture closure pressure can be estimated using predictive and analytical methods. Predictive methods are used to predict fracture closure pressure by developing empirical equations based on the formation geophysical properties, overburden pressure, pore pressure, etc. Analytical methods are used to estimate the fracture pressure during or after running a shut-in or fall-off pressure test. Analytical methods are used to monitor fracture pressure development as the in-situ stresses re-orient and reservoir properties change over time.

Predictive Methods

Known predictive methods of determining fracture closure pressure include use of the Hubbert and Willis equation, the Matthews and Kelly equation, and the Eaton equation. Hubbert and Willis (1957) developed an early correlation for fracture pressure prediction. They found that fracture pressure is a function of overburden stress, formation pore pressure, and horizontal-to-vertical stress ratio. Matthews and Kelly (1967) introduced a matrix stress coefficient that accounts for the effect of depth on the horizontal-to-vertical stress ratio. Eaton (1975) addressed the effect of overburden gradient, Poisson's ratio, and pore pressure gradient.

Analytical Methods

Known analytical methods for estimating fracture closure pressure include the Step Rate Test Analysis, G-Function Analysis, Square Root of Time Analysis, and Log-Log Diagnostic Plot Analysis.

The Step Rate Test Analysis, developed by Felsenthal (1974) proposed new injection test procedures involving injecting water into the formation at different flow rates. A flow rate is kept constant until injection pressure stabilizes, then the flow rate is stepped higher. Stabilized pressure values are plotted versus corresponding flow rates, with fracture pressure at the intersection of the slopes indicating transition from matrix to fracture flow. However, the intersection point is higher than actual fracture pressure due to additional friction losses across the tubing and the perforated interval during injection. Upon transition to fracture flow, the fracture growth can be monitored with time following the analysis procedures by Singh, et al. (1987).

The "G-Function" technique is a well-known method for analyzing the pressure fall off data and has been used in monitoring the evolution of formation stress and to identify the fracture closure point after each injection batch. The G-Function Analysis is a time function used to estimate fracture closure time and reservoir permeability. This technique is considered a pre-closure analysis of the fall-off test, and it is dependent on pressure leak-off rate. Nolte (1979) introduced equations to calculate the G-function.

Square Root of Time Analysis was introduced by Howard, et al. (1957) as a method to determine fracture closure pressure by plotting fall-off pressure versus the square root of shut-in time, where fracture closure is identified when the declining pressure starts to deviate from linearity. Later, Baree, et al. (2009) suggested that fracture closure can be determined from plotting the pressure derivative, where departure of the derivative from a straight line represents fracture closure.

The log-log diagnostic plot of pressure drop and the logarithmic derivative, computed as the derivative of pressure with respect to the logarithm of superposition time, is a conventional method used to interpret any transient well test. The pressure derivative shows different characteristic slopes, each of which can be interpreted as a specific flow regime. Radial flow is represented by flat line (zero slope), linear flow is represented by a half slope line, and bilinear flow is represented by a quarter slope line. Mohamed, et al. (2011) showed that the fracture closure can be picked from the log-log diagnostic plot when the logarithmic pressure derivative departs the 3/2 slope.

Analytical methods can be used to determine the fracture closure pressure (formation stress) from the pressure fall off data after the completion of each injection batch. However, these analytical methods require stabilized fall-off pressure data to identify the transition from fracture linear flow regime to matrix radial flow regime. While a disposal formation is early in its life cycle, fall-off pressure routinely stabilizes shortly after shut-in. This short stabilization period makes use of these analytical methods possible. A shortcoming of such methods is the difficulty of use when the pressure drop-off period becomes extended as the waste disposal formation ages.

Formation Changes Over Long-Term Operations

As explained above, waste disposal operations at a formation can involve thousands of batches of slurry disposal carried out over years. Intensive fracturing injection and addition of waste solids changes the formation over time. As slurry waste injection continues, damage accumulates over the fracture faces. The damaged fracture faces result in slowing down of the pressure leak-off rate. The formation damage can delay fracture closure for extended periods, even up to several days. Well shut-in for such a long time between the batches, which would be required to complete a fall-off test, is impractical.

Without adequate fall-off pressure testing, of course, the conventional pressure fall-off analytical methods described above cannot be used to determine a fracture closure pressure or formation stress, or the incremental increases thereof over time. All the after-fall treatment analytical methods require monitoring of the shut-in pressure data to identify the transition from linear flow (fracture flow) to radial flow (matrix flow) regimes. Fracture closure time can be too long to be practical, for example, in mini-frack tests in tight formations (shales, low permeability sands), or waste fluid injection in reservoirs with low native permeability or with significant near-wellbore damage. In these situations, it can take several days for the shut-in pressure to stabilize enough for conventional pressure fall-off tests analyses to be used.

The resulting uncertainty in formation capacity, for example, leads to risk of potential breach of containment or to inefficient disposal operations.

The ISIP Analytical Method of Determining Fracture Closure Pressure

Hence, a new method of predicting the fracture closure pressure is needed where fracture closure does not occur in a timely manner. Presented is a new predictive, analytical and empirical method allowing monitoring of incremental stress evolution even when the leak-off rate is slow, the fracture closure time is extended, or well shut-in time between injection batches is not sufficient to allow fracture closure.

The developed model, used to monitor the stress increment over the well lifetime, alleviates the need for long shut-in time to perform a fall-off test. The new technique predicts fracture closure pressure and formation stress based on knowledge of Instantaneous Shut-In Pressure (ISIP) and the injection formation properties, including porosity, permeability, overburden stress, formation pore pressure, Young's modulus, and Poisson's ratio.

It is common practice in the industry to estimate geomechanical properties of the injection formation from the measured well logs, mainly gamma ray, porosity, bulk density, and compressional and shear sonic velocities. Therefore, log data may be substituted for the geomechanical inputs in the correlation equations. Further, while the geomechanical formation properties listed are believed to be the properties most likely to correlate to the coefficients, others may be used. Also, not all of the properties need be used, especially where inclusion of one or more properties results in little change in the equation outcomes. Finally, while the equation uses a linear fit, which is demonstrably sufficient, non-linear fits may be used as well.

The ISIP Analytical Method can be used to predict incremental stress increase over time, even when well shut-in durations are shorter than fracture closure times. As a result, safe injection operations can be conducted by assuring that stress increments are within allowable limits without extending the shut-in period after injections. Another advantage of the technique is that it assists in optimization of the injection parameters to achieve the maximum possible injection capacity of the formation.

Instantaneous Shut-in Pressure

Figure 2:
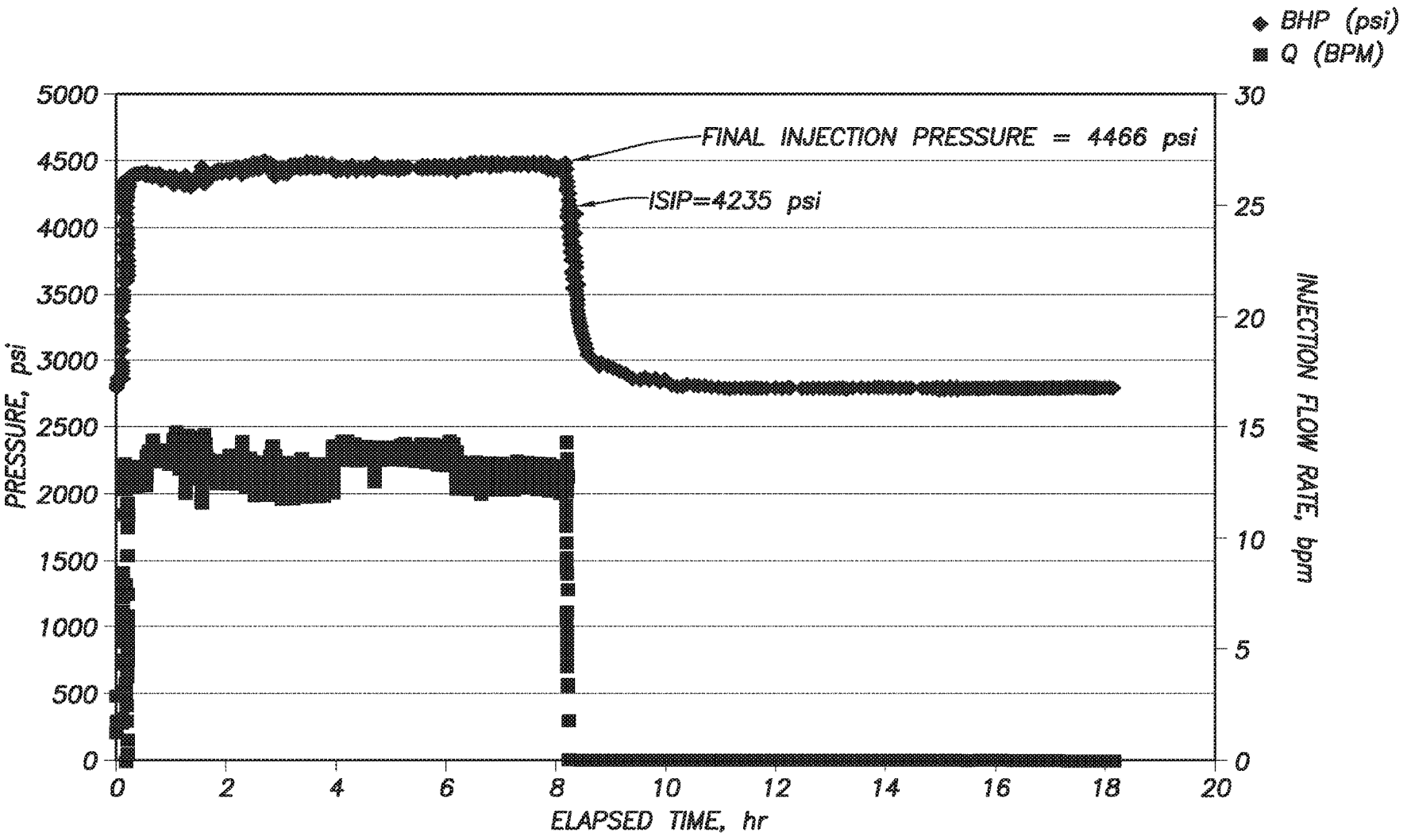
FIG. 2 is a graph of injection pressure and flow rate over time during the end of an injection cycle and after shut-in according to an embodiment of the disclosure herein.

Instantaneous Shut-In Pressure is the final downhole injection pressure minus the friction losses across the injection tubing. The ISIP is recorded at shut-in of the well after injection of a waste cycle or batch. FIG. 2 is a graph of injection pressure and flow rate over time during the end of an injection cycle and after shut-in. The final injection pressure 50 is indicated, as is the ISIP 52.

Methods for determining ISIP are known in the art. In situ stress determinations by hydraulic fracturing rely on the fact that ISIP is equal to the stress acting perpendicular to the plane of the fracture. Multiple methods are recognized for determining ISIP from fall-off test data. For example, ISIP can be estimated by the exponential decay method (Muskat 1937), the inflection point method (Gronseth, et al. 1983), and dP/dT method (Haimson, et al. 1987). The methods give ISIP values within a narrow range, confirming the accuracy of ISIP selection methods. Another method is the non-linear regression method for isolating the negative exponential portion of the decay curve.

ISIP does not typically remain constant from cycle to cycle. That is, ISIP varies over time as indicated by differing ISIP data obtained after shut-in tests following successive injection cycles. This is not a surprise, as the fracture closure pressure also changes over the lifetime of an injection operation and is determined by analyzing shut-in pressure data after each batch injection.

Predicting Fracture Closure Pressure from ISIP

Recognizing that a relationship exists between fracture closure pressure and Initial Shut-In Pressure, an empirical equation is used to calculate fracture closure pressure as a function of the ISIP and formation properties. Fracture closure pressure (Pc) is obtained from the following Eq. 1, where: $C_1$ and $C_2$ are linear correlation coefficients:

$$Pc=(C_1)(\text{ISIP})+C_2 \tag{1}$$

Generic form linear coefficients are used to estimate the fracture closure pressure from ISIP. Several petrophysical reservoir properties are used in the ISIP Analysis Method. In a preferred embodiment, formation properties which can be used include permeability, porosity, overburden stress, formation pore pressure, Young's modulus, and Poisson's ratio.

The generic formulae for $C_1$ and $C_2$ are given in Eq. 2 and 3:

$$C_1=C_{1,K} \tag{2}$$

$$C_2=(C_{2,E}+C_{2,v}+C_{2,P})+C_{2,s}+C_{2,\varphi})/5 \tag{3}$$

Where, $C_{1,K}=-0.0031K+0.8343$; $C_{2,E}=0.00005E+340.78$; $C_{2,v}=0.4435$ EXP(25.695v); $C_{2,P}=0.3139P+92.077$; $C_{2,s}=0.15335+37.046$; and $C_{2,\varphi}=(-13618)\varphi+3152$.

Where, K is formation permeability, typically in mD; E is Young's modulus of elasticity, typically in psi; v is Poisson's ratio; P is formation pressure, typically in psi; s is overburden stress; and φ is porosity, a fraction.

The ISIP Analysis Method predicts the fracture closure pressure from ISIP based on knowledge of formation properties, i.e. Young's Modulus, Poisson's ratio, pore pressure, overburden pressure, porosity, and permeability. The Method is acceptable over a range of formation property parameters.

Application of the ISIP Analysis Method

In use, the ISIP Analysis Method is used to predict fracture closure after a fracturing injection cycles in a disposal well where the fracture closure rate or leak-off rate is too slow to allow for timely pressure fall-off test data to the point of closure or before another disposal cycle is desired to be run.

Equation 1 is used to calculate fracture closure pressure or formation stress. The linear coefficients $C_1$ and $C_2$ are calculated using Equations 2 and 3, respectively. The equations call for the use of formation parameters as described above. Those parameters, of course, vary by formation, field, zone, etc.

Measurement and determination of the formation parameters and properties is well known in the art. Formation permeability can be determined, for example, from the radial flow regime. Radial flow is defined by a zero slope line on the pressure derivative curve in the log-log diagnostic plot and it exists in the time period before the pressure transient has reached the reservoir boundaries.

Formation porosity can be obtained from, for example, side hole cores collected from a formation. Various methods of obtaining formation porosity are known in the art. Pore Pressure can be obtained from, for example, sonic logs which predict the formation pore pressure using known equations. Overburden pressure can be determined, for example, from bulk density logs. Poisson's ratio, for example, can be calculated using sonic logs and known equations. Similarly, Young's modulus can be calculated, for example, using Canady's (2011) formula to calculate the static Young's modulus of a formation. Persons of skill in the art will recognize that various measurements and calculations can be used interchangeably to find the various formation properties mentioned, as well as others.

Building the ISIP Analysis Method

Reed well is located in West Texas and is completed to the Wilcox Formation. Reed well is a Class II waste injector. In general, Class II wells are used for downhole disposal injection of all types of non-hazardous waste produced by drilling and production operations, such as oil-based mud, water-based mud, drill cuttings, and oily produced water. Based on best practices, waste injection is conducted in cycles or batches so that hydraulic fractures are initiated by clean water, then waste slurry is injected to propagate the fractures and fill the fractures and nearby areas. The well is then shut-in, pressure drop-of measured, and the fracture closed before starting a new injection cycle.

After each cycle, the ISIP was determined and, separately, the fracture closure pressure was determined using standard analytical methods, namely the G-Function Analysis Method. Both ISIP and fracture closure pressure were determined batch-by-batch based on shut-in pressure analysis. FIG. 2 above addresses determination of ISIP.

Figure 3:
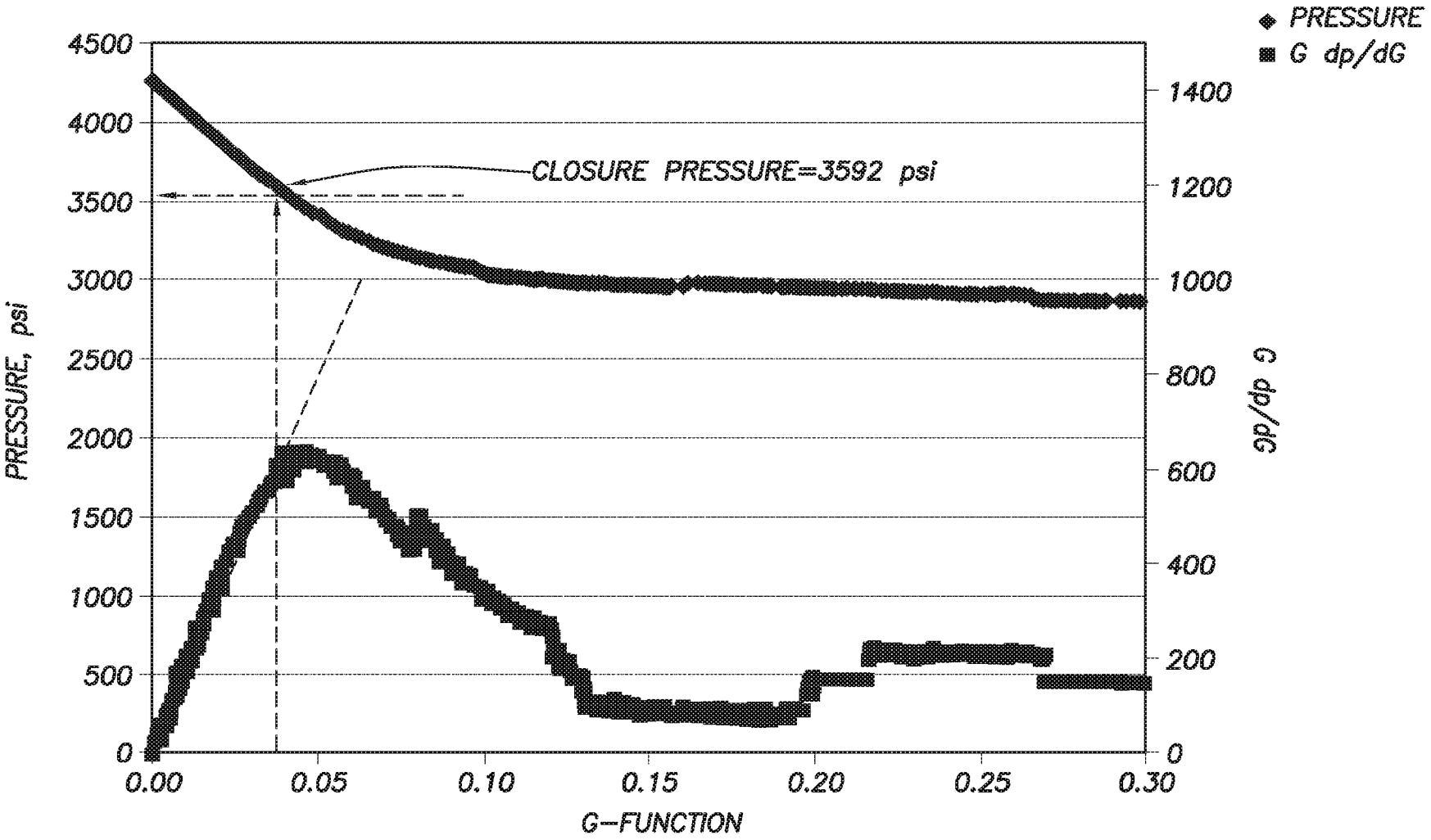
FIG. 3 is a graph showing fracture closure pressure and G dp/dG versus the G-Function according to an embodiment of the disclosure herein.

FIG. 3 is a graph showing fracture closure pressure, in psi, and G dp/dG versus the G-Function. FIG. 3 illustrates determination of the fracture closure pressure from a G-Function analysis for the Reed well and indicates fracture closure pressure 54. The G-function is a time function that was introduced by Nolte [21] to identify the fracture closure from the shut-in pressure data after a hydraulic fracture treatment/injection. This time function is dependent on pressure leak-off rate and is calculated using the below set of equations:

$$\Delta t_D=\left(\frac{t-t_p}{t_p}\right) \tag{4}$$

$$g(\Delta t_D)=\frac{4}{3}[(1+\Delta t_D)^{1.5}-\Delta t_D^{1.5}] \tag{5}$$

$$G(\Delta t_D)=\frac{4}{\pi}(g(\Delta t_D)-g_o) \tag{6}$$

Figure 4:
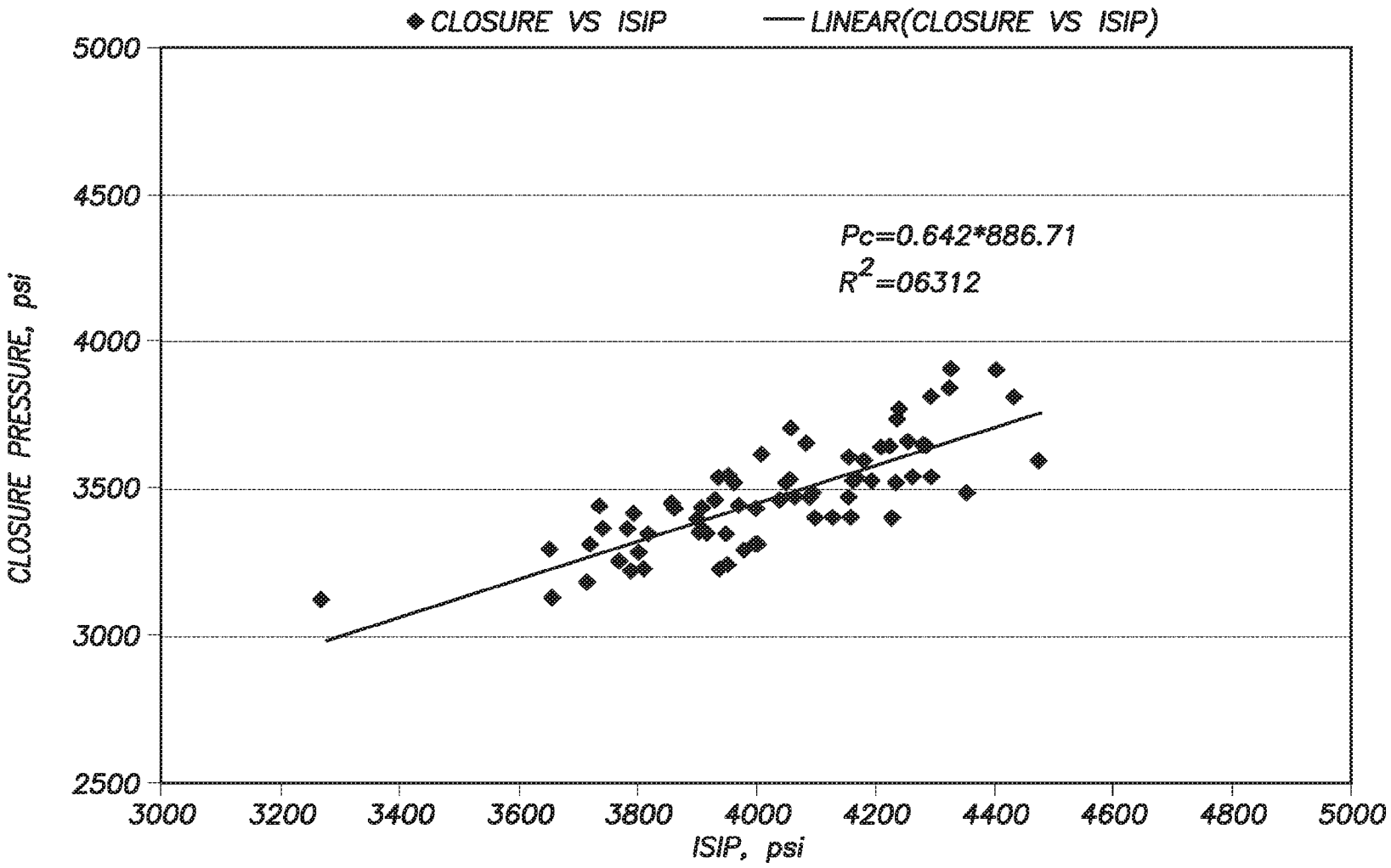
FIG. 4 is a graph of fracture closure pressure versus ISIP according to an embodiment of the disclosure herein.

A clear relationship exists between the fracture closure pressure and the ISIP for Reed Well. FIG. 4 is a graph of fracture closure pressure versus ISIP, both measured in psi.

FIG. 4 indicates a correlation between ISIP and fracture closure pressure for the exemplary Reed Well with data points taken from historical well data. In fact, the correlation exhibits a linear relationship between ISIP and fracture closure pressure (Pc), expressed as $Pc=(C_1)(ISIP)+C_2$, where: $C_1$ and $C_2$ are linear correlation coefficients.

Field Specific ISIP Analysis Method

Note that the method described above can be used to determine a formation-specific equation for determining fracture closure pressure from ISIP. In such a case, known historical data is used to plot fracture closure pressure calculated using traditional methods such as G-Function. This data was collected or calculated before significant damage occurred to the formation, such that actual fracture closure occurred during shut-in. Historical ISIP data can then be used to plot or otherwise correlate fracture closure pressure versus ISIP and determine a formation-specific equation relating the two. The method described uses a linear fit for correlating the two sets of data (fracture closure pressure and ISIP), although other fits, such as non-linear fits can be used. Once determined, the equation can be used to predict fracture closure pressure (Pc) using ISIP after formation damage delays fracture closure.

For the Reed Well, the historical data included fracture closure pressure and ISIP points taken after shut-in of numerous disposal cycles, including cycles of 1000-2000 bbl of slurry, 2000-4000 bbl of slurry, 4000-10000 bbls of slurry, and cycles of dirty water. The Reed Well specific equation was determined to be $Pc=(0.642)(ISIP)+886.71$, with an error of $R^2=0.6312$.

More generally, for a given well, linear regression fitting can be applied to historical data in order to get a relationship that can predict future fracture closure pressure. Historical data can include fall-off data, recorded ISIP values (or later-calculated ISIP values based on the historical fall-off data), and fracture closure pressure values determined from conventional methods of analyses. This new relationship would be useful when the conventional methods for the evaluation of fracture closure pressure are unable to identify the transition from linear flow (fracture flow) to radial flow (matrix flow) regimes.

Generalized ISIP Analysis Method

The same procedures were used to obtain the relationship between fracture closure pressure and ISIP for several injectors with different lithology, reservoir properties, mechanical properties, and depths. The results confirmed the linear relationship between ISIP and closure pressure.

Generic form linear coefficients are used to estimate the fracture closure pressure from ISIP. The generic equation is developed following the steps: (1) Collect reservoir properties for the available wells; (2) Test which property is a function of $C_1$ and which is a function of $C_2$, eliminating all the correlations with a fitting error ($R^2 \geq 0.5$); (3) Combine the correlations from step 2 to get the generic forms for $C_1$ and $C_2$; and (4) Calculate the absolute error in estimating the constants $C_1$ and $C_2$.

Formation properties were measured and calculated for the Wilcox Formation using historical data from Reed Well and four surrounding wells. Formation permeability, porosity, pore pressure, overburden stress, Poisson's ratio, and Young's modulus were determined using techniques well known in the art.

Figure 5:
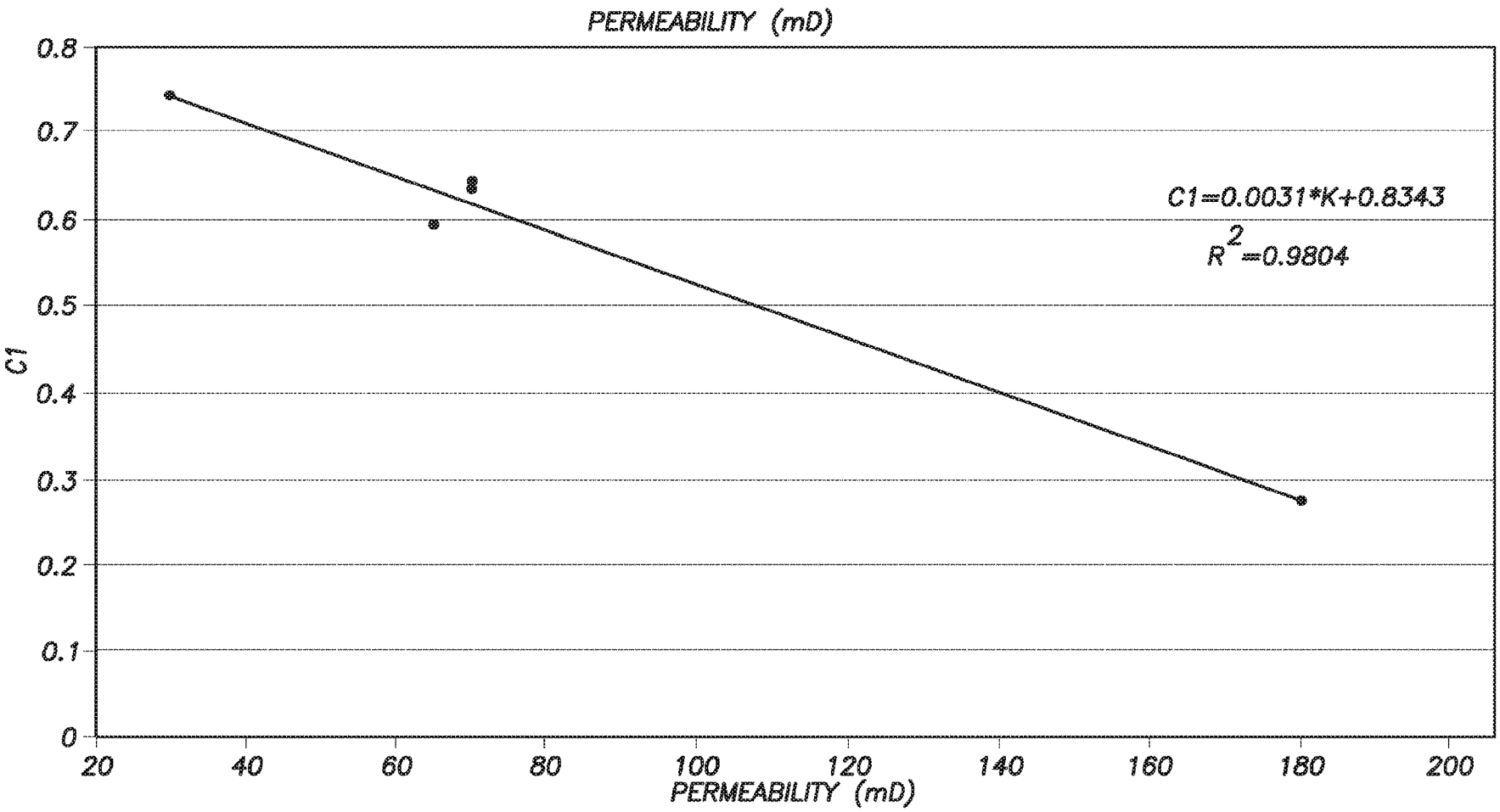
FIG. 5 is an exemplary graph plotting a reservoir property, permeability, versus a linear coefficient according to an embodiment of the disclosure herein.

Formation properties were plotted versus each of the linear coefficients, $C_1$ and $C_2$. For example, FIG. 5 is an exemplary graph plotting a reservoir property, permeability, versus a linear coefficient, $C_1$. Similar plots were run for the other formation properties and coefficients but not shown.

Correlations beyond a selected fitting error were eliminated. In this example, correlations with a fitting error of $R^2 \geq 0.5$ were eliminated. Other fitting errors can be used.

The acceptable correlations were combined to produce generic forms for $C_1$ and $C_2$ as in Equations 2 and 3 above, namely, $C_1=C_{1,K}$ and $C_2=(C_{2,E}+C_{2,v}+C_{2,P}+C_{2,s}+C_{2,\varphi})/5$. The results show $C_1$ is a function of formation permeability while $C_2$ is a function of porosity, pore pressure, overburden pressure, Poisson's ratio and Young's Modulus.

The generic formulae are as follows: $C_{1,K}=-0.0031K+0.8343$; $C_{2,P}=0.3139P+92.077$; $C_{2,E}=0.00005E+340.78$; $C_{2,s}=0.15335+37.046$; $C_{2,v}=0.4435\ EXP(25.695v)$; and $C_{2,\varphi}=(-13618)\varphi+3152$.

For Reed Well, using the ISIP Analysis Method, $C_1$ and $C_2$ were determined to be: $C_1=0.6173$ and $C_2=887.24$. This compared closely to the G-Function Analysis Method which yielded $C_1$ and $C_2$ as follows: $C_1=0.642$ and $C_2=886.71$. Similarly close results were produced for the surrounding wells.

Figure 6:
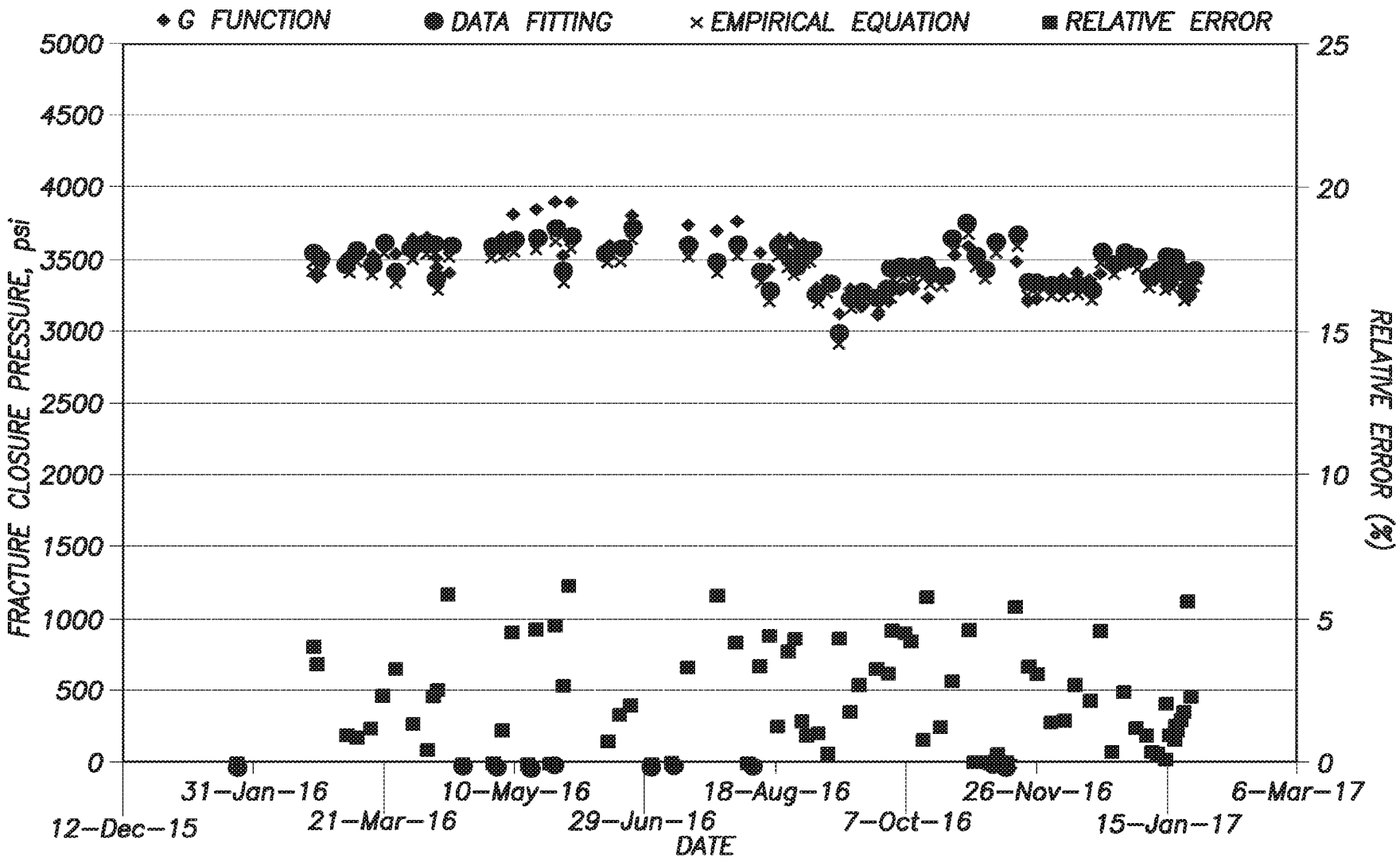
FIG. 6 is a graph showing a comparison between fracture closure pressure from the G-Function Analysis Method and from the ISIP Analysis Method for a well according to an embodiment of the disclosure herein.

The original values of $C_1$ and $C_2$, obtained from the linear fitting of injection history data for the exemplary well, were compared to the calculated values obtained from the new formulae. FIG. 6 is a graph showing a comparison between the fracture closure pressure from the G-Function Analysis Method and from the ISIP Analysis Method for the Reed Well, indicating a relative error of 3%. The discrepancies are due to the different levels of uncertainty in calculating the different reservoir properties of the injection formation.

The ISIP Analysis Method was validated using different case studies by comparing the predicted fracture closure pressure calculated from the developed empirical equations to the measured fracture closure pressure value. The new correlation predicted the fracture closure pressure with a relative error of less than 6%. Also, the ISIP Analysis Method was used to predict the fracture closure pressure in a shale formation, and it was able to predict the closure pressure with less than 3% error.

Case Study No. 1, Repetto Sand, Calif.

Well SFI #3 is a biosolids injector used to inject waste downhole into the Repetto Sand formation. The well and formation have the following properties: perforation top depth is 4959 feet; porosity is 22%; permeability is 110 mD; Poisson's ratio is 0.33, Young's modulus is 1.5 Mpsi, and Pore Pressure is 1977 psi.

The ISIP, as determined from a bottom hole pressure curve, was 3685 psi. The fracture closure pressure as determined using G-Function Analysis was 2620 psi. The ISIP Analysis Method were used to calculate both $C_1$ and $C_2$ and the results were as follows: $C_1=0.4933$; and $C_2=842.07$. The fracture closure pressure was calculated as 2660 psi using ISIP Analysis Method. The ISIP Analysis Method provided results quite close to the value obtained from traditional G-Function Analysis.

Case Study No. 2, Vaca Muerta Shale, Argentina

Vaca Muerta shale is a gas bearing formation in Argentina and a mini-frac test was conducted to determine the fracture pressure and the formation permeability so that a fracture stimulation schedule could be designed later. Vaca Muerta Properties were determined as follows: porosity of 11%; pore pressure of 7600 psi, perforation top depth is 9100 feet; Young's modulus of 1.4 Mpsi; Poisson's ratio of 0.22. The mini-frac test results were as follows: ISIP of 8482 psi, Pc of 8270 psi, K of 0.0009 mD. The ISIP Analysis Method resulted in findings of $C_1=0.834$, $C_2=1209.896$, and $Pc=8286$ psi. Again, the Pc calculation using the G-Function Analysis and ISIP Analysis methods were very similar.

Using ISIP Analysis to Predict Incremental In Situ Stress Increases

The ISIP Analysis Method can be used to monitor formation stress and formation closure pressure incremental evolution where well shut-in time between cycle injections is insufficient to allow fracture closure. The ISIP Analysis Method helps predict stress incremental increase over time even when the well shut-in duration is shorter than the fracture closure time. Safe injection operations can be conducted by assuring that stress increments are within allowable limits without extending the shut-in period after each injection. The ISIP Analysis can also be used to optimize injection parameters to achieve the maximum possible injection capacity of the formation.

The injection pressure data from biosolids injection operations at Terminal Island, in Los Angeles, Calif., was used to validate use of the ISIP Analysis Method as a predictive technique for incremental stress increases. The G-Function Analysis Method was used to identify the fracture closure pressure in the early well-life when the formation was not severely damaged and the leak-off rate was still rapid. In later injection batches, damage accumulation did not allow fracture closure to occur during the well shut-in. Hence, the new technique was successfully used to build a stress increment profile of the injection formation.

During early well-life, the match between the predicted fracture closure pressure values using the ISIP Analysis Method and those obtained from the G-Function Analysis Method was excellent, with an absolute error of less than 3%. At later injection batches, the predicted stress increment profile shows a clear trend consistent with the mechanisms of slurry injection and stress shadow analysis. Furthermore, the injection operational parameters such as injection flow rate, injected volume per batch, and the volumetric solids concentration have strong impact on the predicted injection formation capacity. In addition, the injection formation capacity increases when the injection flow rate and the injected volume per batch increase.

The biosolids waste injector well at Terminal Island is used to dispose 125-250 tons/day of digested sludge/wet-cake that is produced by the Terminal Island Water Reclamation Plant of Los Angeles. This well is drilled vertically and completed to a deep sandstone formation. The targeted injection formation is made of permeable sand layers with interbedded thick shale layers. The depositional environment of this injection zone is interpreted as a submarine-fan setting which consists of sandy and conglomeratic submarine channel-fill facies. The geological reports indicate that the injection zone is about 1000 feet thick in the proximity of the injection well. Moreover, there is a thick shale layer of 200 to 800 feet over the injection zone which acts as a boundary layer.

Figure 7A:
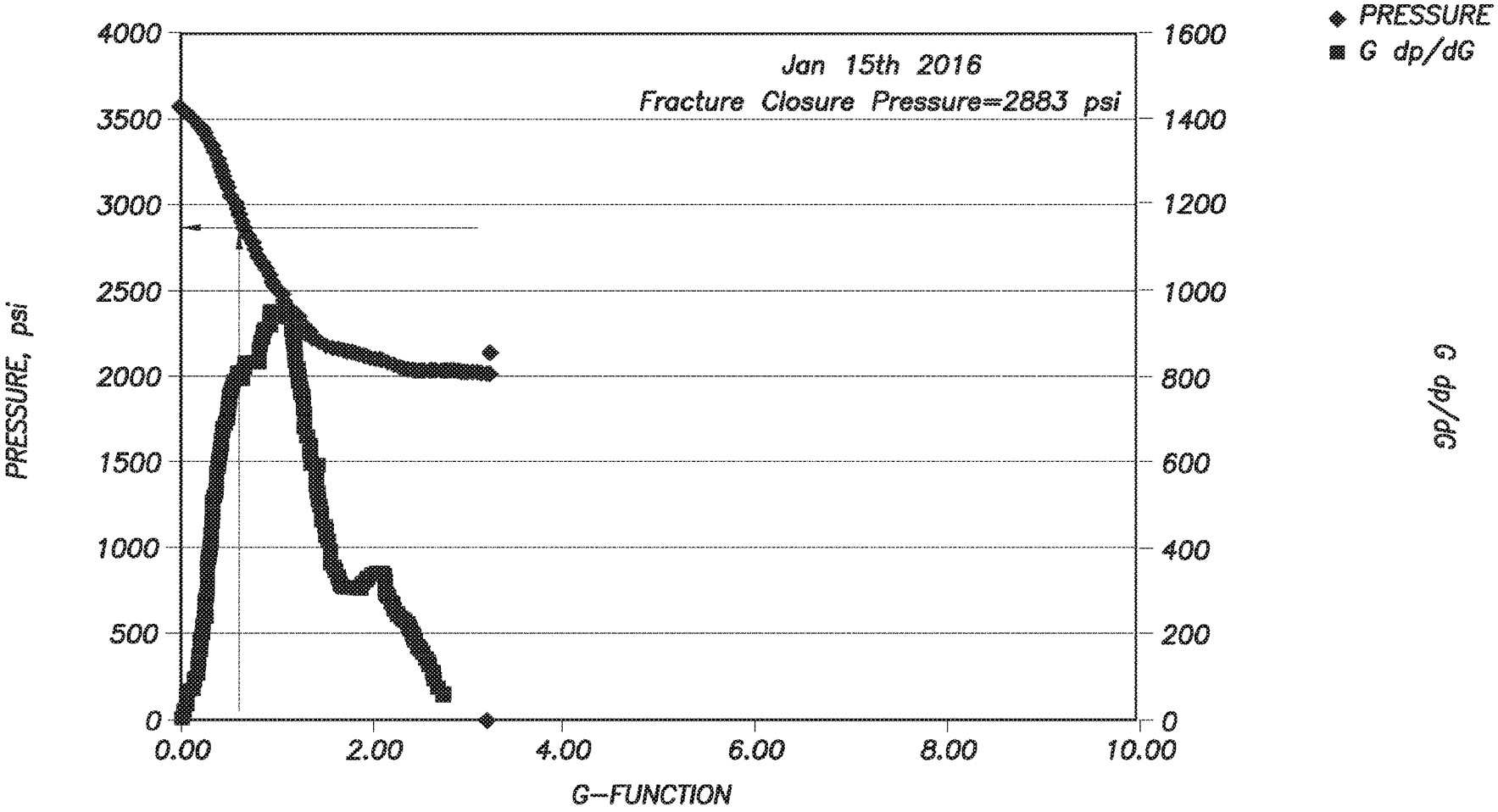
Figure 7B:
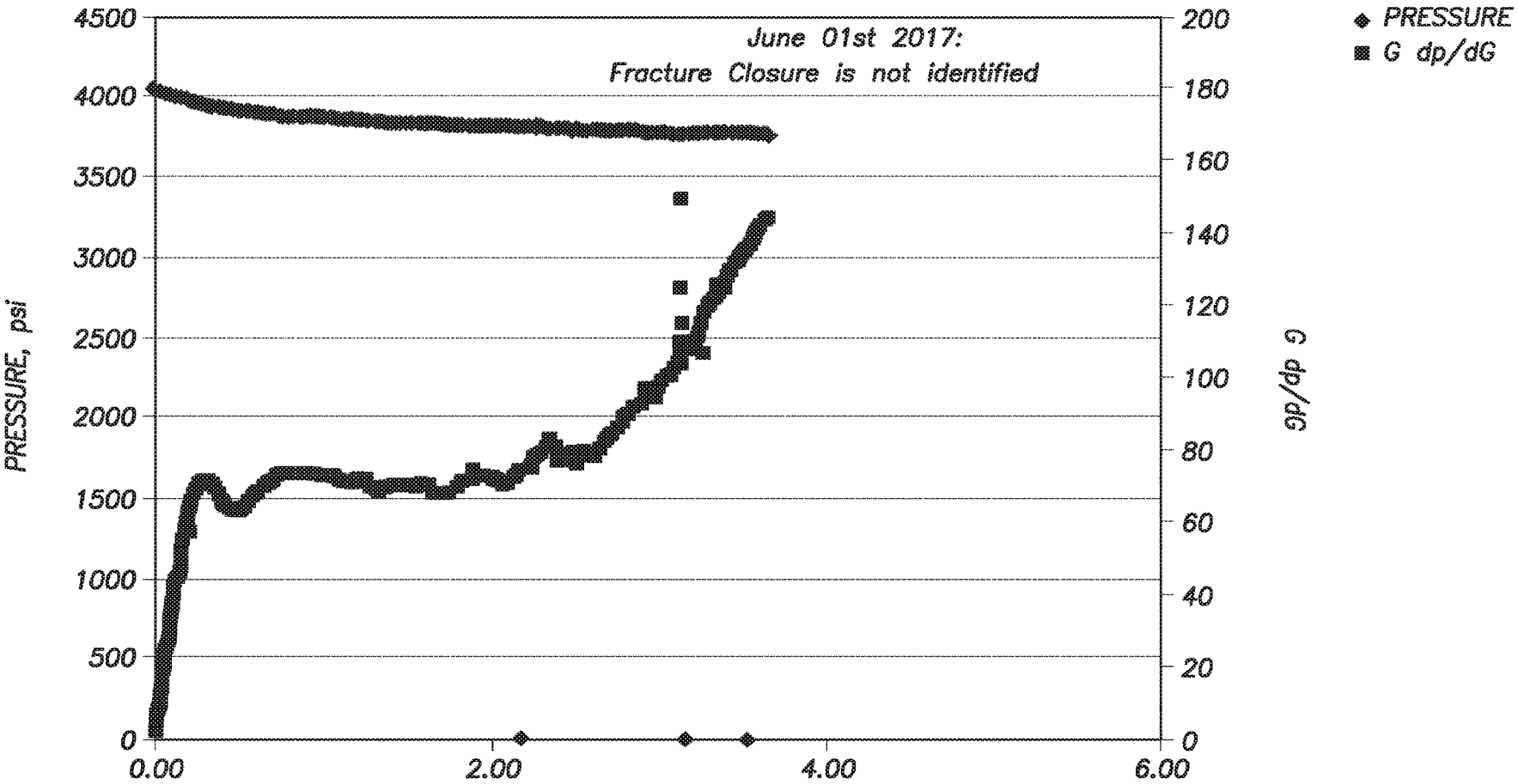
FIG. 7B is a graph showing similar G-Function Analysis during a later life stage of the same injection well of FIG. 7A, when fracture closure is difficult to achieve during the well shut-in period according to an embodiment of the disclosure herein.

G-Function Analysis was used to identify the fracture closure from the pressure fall-off data after the completion of each injection batch. FIG. 7A is a graph showing fracture closure pressure using G-Function Analysis during an early life stage of an injection well, when fracture closure occurs in a relatively short time period after shut-in. FIG. 7B is a graph showing similar G-Function Analysis during a later life stage of the same injection well, when fracture closure is difficult to achieve during the well shut-in period. FIG. 7A shows that the fracture closure is clearly identified soon after injection shut-in. After a year of disposal injections, the injected biosolids caused formation damage accumulation on the fracture faces which, in turn, slowed fluid leak-off rate. Ultimately, fracture closure was difficult to achieve during the well shut-in period as shown in FIG. 7B.

It is essential to monitor the stress increase after each injection cycle or batch over the lifetime of the biosolids injection well to ensure that fractures are always contained within the target injection zone and without breach to the upper and lower boundary formations.

In addition, such knowledge helps in the design of optimum injection operations to alleviate incremental formation stress increases. The ISIP Analysis Method was assessed for its competency to monitor stress increment in cases where fracture closure could not be identified by conventional analytical techniques.

In-Situ Stress Prediction

The ISIP Analysis Method was used to predict fracture closure pressure after each injection batch by identifying both the ISIP and static formation properties including: porosity, permeability, Young's modulus, Poisson's ratio, pore pressure and overburden pressure.

These properties were used as inputs into Equations 1, 2, and 3 described above. The formation properties required to estimate coefficients $C_1$ and $C_2$ were obtained. Formation porosity was obtained from wireline well logs for the biosolids injector, which included gamma ray, bulk density, porosity, and sonic velocities. The porosity had an average value of 22%.

Formation Permeability was taken from an analysis of pressure fall-off data obtained during an injection test in the early stage of the well life and was obtained using a Horner log-log diagnostic plot (1951). The formation permeability was estimated at 100 mD.

Poisson's ratio of 033 was determined using available sonic data from well logs and equations for determining the ratio. Young's modulus was calculated based on the model introduced by Canady (2011). First, the dynamic modulus was calculated using bulk density and shear velocity log data. Then the value was converted into static Young's modulus of 1.5 Mpsi. Overburden pressure was 4706 psi. Pore pressure was 1891 psi. The injection zone thickness was 365 feet.

The $C_1$ and $C_2$ Coefficients were determined as $C_1$=0.5243 and $C_2$=828.9097. Eq. 2 and Eq. 3 determine the model coefficients based on the log-derived formation properties.

Stress Increment Monitoring and Formation Capacity Prediction

As slurry waste injection continues at the well, damage accumulates over the fracture faces and slows down the pressure leak-off rate. This formation damage is mainly caused by intensive daily injection of biosolids which does not allow the fracture to close timely. The ISIP Analysis Method, used to monitor the stress increment over the well lifetime, helps alleviate the need for long shut-in times.

The injection period of study can be divided into four main Intervals with respect to changes in batch size or injection flow rate as shown in Table 1.

TABLE 1

Injection Intervals of the Biosolids Injector

| Interval # | Flow Rate (bbl/min) | Daily Batch Volume (bbl) |
|---|---|---|
| I | 8 | 5825 |
| II | 8 | 7850 |
| III | 10 | 10500 |
| IV | 10 | 8080 |

Figure 8:
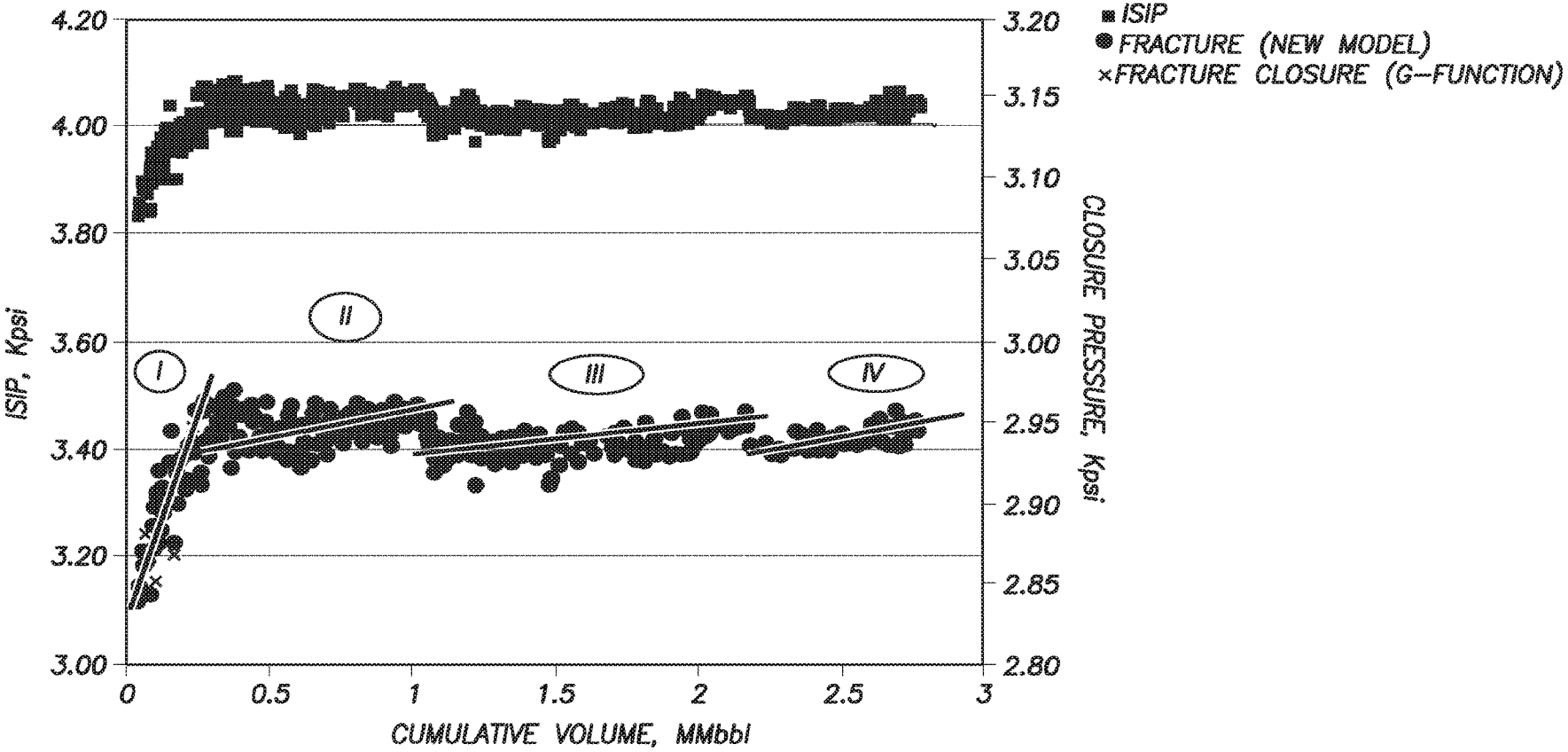
FIG. 8 is a graph showing ISIP and predicted fracture closure pressure versus Cumulative Volume of waste disposal according to an embodiment of the disclosure herein.

FIG. 8 is a graph showing ISIP (Kpsi) and predicted fracture closure pressure (Kpsi) versus Cumulative Volume (MMbbl) of waste disposal. FIG. 8 shows that the predicted fracture closure pressure values level off at 2980 psi, which is smaller than the upper barrier stress value of 3800 psi. Also, injection Interval I shows a rapid increase in in situ stress which might be related to the initial damage build-up that accumulated on the fracture faces. Intervals II, III, and IV are indicated on FIG. 8, as are clear trends in fracture closure pressure showing fracture pressure increase over time and corresponding increases in waste disposal volume. The trend lines per Interval indicate incremental increases in fracture closure pressure and formation stress.

Figure 9A:
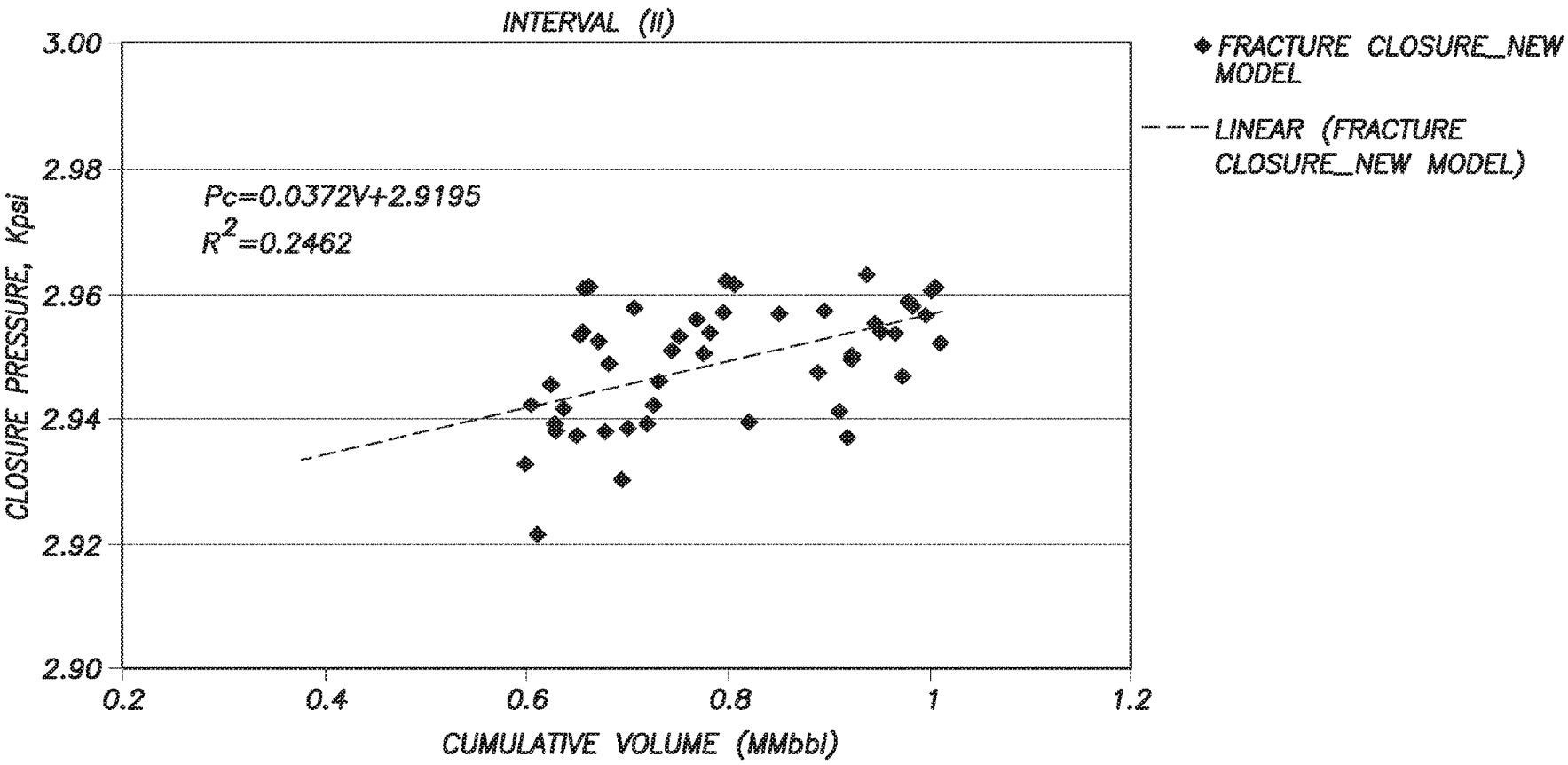
FIGS. 9A-C are graphs of predicted fracture closure pressure versus cumulative disposal waste volume over time and over disposal Intervals II-IV according to an embodiment of the disclosure herein.
Figure 9B:
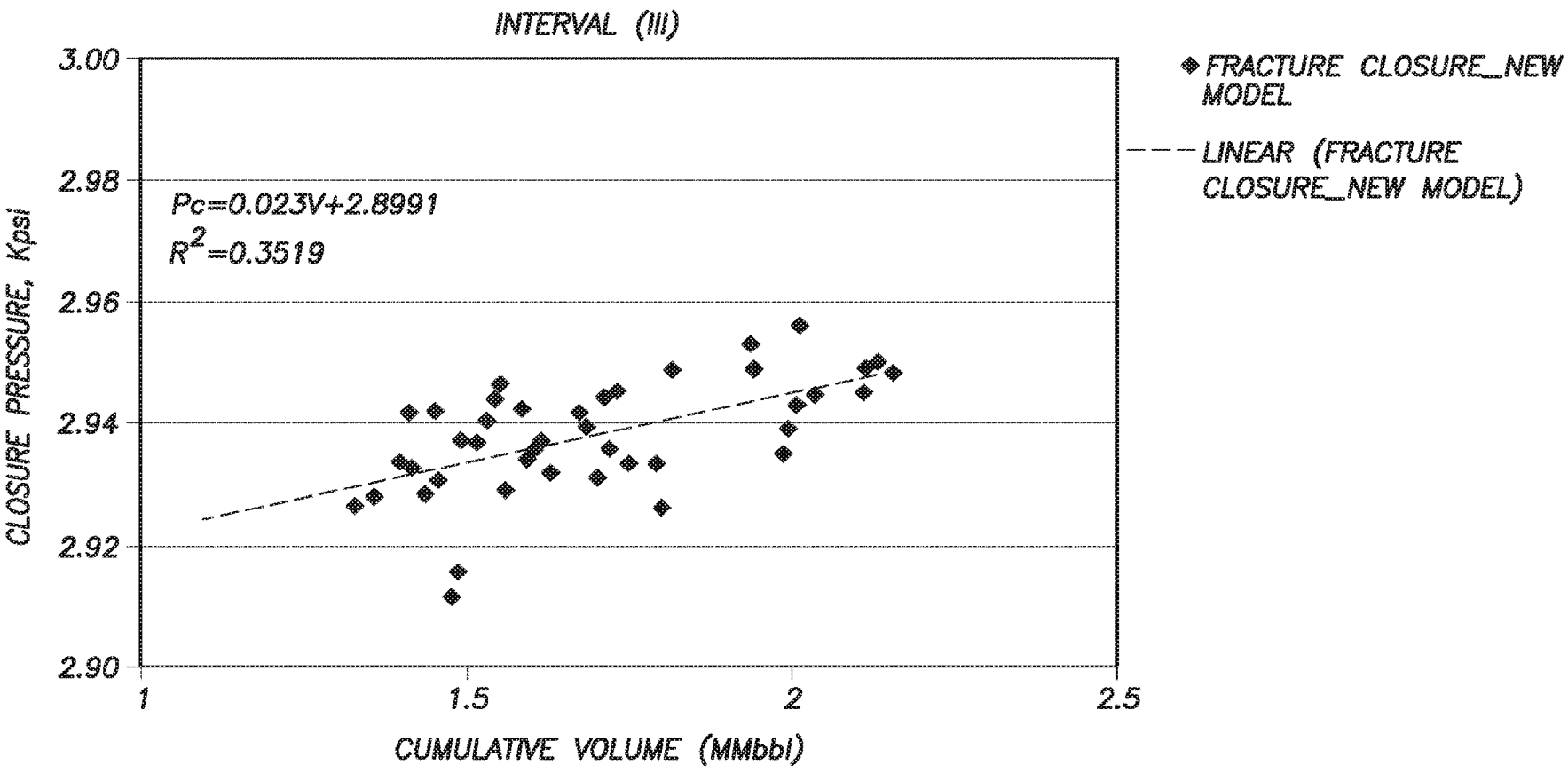
Figure 9C:
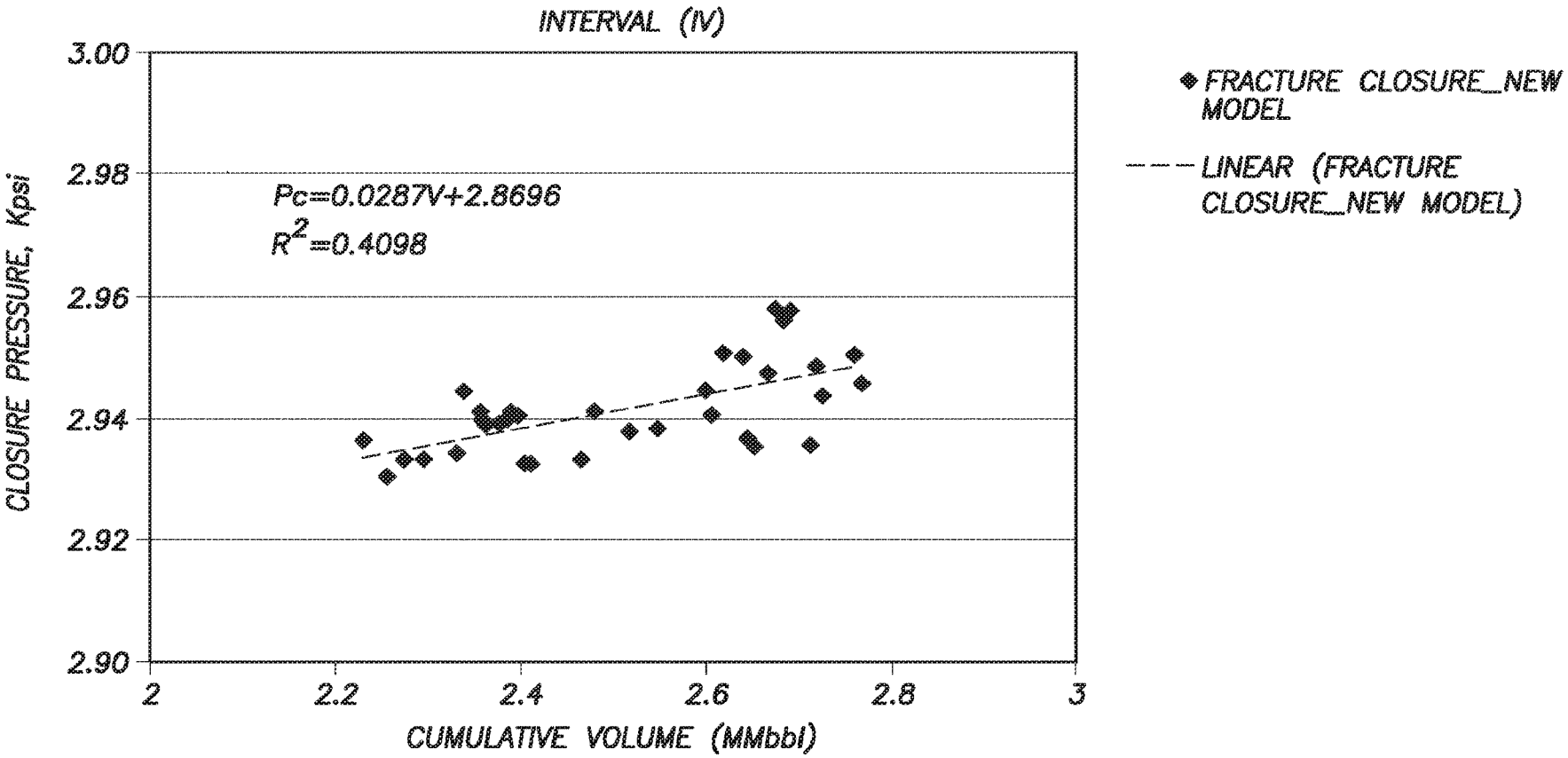

Each of the injection Intervals II, III, and IV was assessed individually to quantify the stress increment rate over time and to evaluate the formation disposal capacity for each of the three injection intervals. Linear fits of the data guided prediction of stress incremental increase over time for each of the Intervals as shown in FIGS. 9A-C. FIGS. 9A-C are graphs of predicted fracture closure pressure versus cumulative disposal waste volume over time and over disposal Intervals II-IV. The indicated fracture closure pressures are based on the ISIP Analysis Model and linear fracture closure. Other models (e.g., non-linear) of fracture closure can be used. The graphs indicate stress increment evaluation for the Intervals.

Interval II indicates a predicted fracture closure pressure, $Pc=0.0372V+2.9195$, with an error value $R^2=0.2462$. Interval III indicates a $Pc=0.023V+2.8991$ with an error value $R^2=0.3519$. Interval IV indicates a $Pc=0.0287V+2.8696$ and an error value $R^2=0.4098$. Here, "V" is volume of solids waste.

The formation capacity is influenced by operating choices. Fracture closure pressure is a function of Volume because each waste batch deposits a certain volume of solids which damage the formation, causing fracture closure pressure to change (increase). Thus, as solids accumulate, damage accumulates, and fracture pressure increases.

FIGS. 9A-C show the fracture closure pressure evolution or incremental increase over the life of the formation as damage accumulated. The slopes indicated on the Intervals are used to predict maximum formation disposal capacity. Again, the slopes are a linear fit while non-linear fits can be used.

The formation disposal capacity was evaluated after prediction of the stress increment rate for each of the three injection Intervals II-IV. The disposal capacity calculations are based on the criterion that the injection formation reaches its maximum capacity when the injection zone in-situ stress equals the upper boundary zone stress value (of 3800 psi) or the overburden stress, whichever is higher. Table 2 summarizes the formation disposal capacity calculations for each of the injection options.

TABLE 2

Formation Disposal Capacity and Stress Increase

| Interval | Stress Increase (Kpsi/MMbbl) | Stress Increase (psi/batch) | Total Dry Solids (metric tons) |
|---|---|---|---|
| II | 0.0372 | 0.292 | 170,700 |
| III | 0.0230 | 0.242 | 276,100 |
| IV | 0.0287 | 0.232 | 221,200 |

The ISIP Analysis Method allows accurate prediction of formation capacity and formation stress incremental increases over time. This data can be used to optimize ongoing formation disposal operations.

Stress Increment Calculations

The developed technique enables monitoring of the stress increment over the well life time, especially when impermeable filter cake of biowaste is formed on the fracture faces, which slows down the fluid leak-off rate. The stress increment calculations can be applied using the developed technique and are summarized as follows:

First, determine the injection zone formation properties: Poisson's ratio, Young's modulus, pore pressure, overburden pressure, porosity, and permeability. Other formation properties can be used.

Second, calculate the developed model coefficients from Eq. 2 and Eq. 3.

Third, use the available ISIP history data to predict the fracture closure pressure history data using Eq. 1.

Fourth, divide the injection history into separate intervals based on any drastic changes in either the injection flow rate or the daily batch volume.

Fifth, for each injection interval, plot the predicted fracture closure pressure versus the cumulative injected volume, the slope of this chart represents the stress increase per injected volume.

Sixth, the maximum disposal capacity of the injection zone is reached when the in-situ stress increment equalizes the stress value of the upper shale barrier. This ensures that the created fracture is always contained within the injection zone by limiting the volume of the injected solids below the maximum capacity.

Optimization of Slurry Waste Disposal

Figure 10:
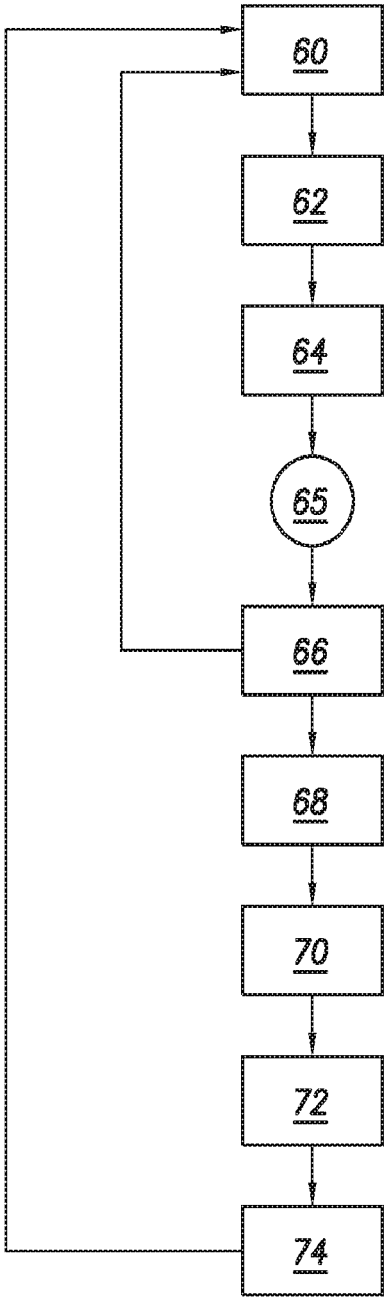
FIG. 10 is a flow chart indicating methods for optimization of waste slurry disposal in fracturing injection wells according to an embodiment of the disclosure herein.

FIG. 10 is a flow chart indicating methods for optimization of waste slurry disposal in fracturing injection wells. A disposal well operation utilizes hydraulic fracturing to dispose of a waste slurry. The waste slurry is injected using pump equipment into the target zone of the formation. Injection is performed in successive cycles or batches. Each cycle is followed by shut-in of the well, that is, cessation of pumping. Pressure data can be taken during and following each shut-in. The formation undergoes change in properties, due to damage, from deposition of solids during injection, damaging the fracture faces and increasing leak-off rates after a cycle.

At step 60, a cycle of waste slurry is injected into the target zone, hydraulically fracturing the zone, at selected cycle and operational parameters. The cycle or batch has known cycle parameters, such as batch volume, solids volume, solids concentration, viscosity, density, particle size, etc. The cycle parameters depend on the type of waste and slurry being injected and can be selected based on the physical and fractural properties of the formation. Further, a cycle is injected by a pump with a known horsepower and pump curve under certain operational parameters, such as a pump rate, pumping duration (time), pump pressure, wellbore pressure, etc. For example, a batch injection duration can be minutes to weeks long.

At step 62, the well is shut-in following an injection cycle. At step 64, a pressure fall-off or shut-in test is performed, measuring pressure versus time. At step 66, fracture closure pressure or formation stress is determined. Fracture closure pressure can be determined using traditional techniques (G-Function, etc.) where the closure occurs when fracture closure occurs in a relatively short time period after shut-in. Fracture closure pressure can be determined using the ISIP Analysis Method where fracture closure is delayed due to a tight or damaged formation as explained above.

Steps 60 to 66 are repeated over a number of injection cycles. Preferably the cycle and operational parameters are the same or similar over a set of injection cycles, referred to as an Injection Interval. That is, for an interval, the cycle parameters and operational parameters are within a selected range. The parameters will obviously vary somewhat due to varying conditions at the disposal well site. Successive cycles result in a cumulative disposal waste volume, measured in cycles or batches, volume of solids disposal, volume of injected slurry, etc. Rest periods 65 following injection cycles accumulate to total rest period measured over a number of cycles or units of time (e.g., rest per week).

At step 68, fracture closure pressure after a cycle is compared to previous fracture closure pressures. At step 70, trends are determined for fracture closure pressure or formation stress over the Injection Interval. For example, predicted fracture closure pressure or formation stress can be plotted versus cumulative volume of waste disposal to determine linear (or non-linear) fracture closure pressure or stress trends over time (or over injection cycles). The change in closure pressure per change in waste disposal volume (solids) can be calculated, for example. Incremental increases in fracture closure pressure or formation stress can be determined over time or over cycles.

At step 72, formation disposal capacity can be predicted based on the trends determined over the Interval. Disposal capacity calculations can be based on the criterion that the injection formation reaches its maximum capacity when the injection zone in-situ stress equals the upper boundary zone stress value or the overburden stress, whichever is higher. Formation disposal capacity can be measured, for example, in total volume of disposed solids. Formation capacity can also be determined taking into consideration facility constraints, operational constraints, permit constraints, etc.

At step 74, one or more operational or cycle parameters are selected for change. A return is made to step 60, utilizing the selected parameter changes, to begin another Interval. Each successive run through of the flow chart is performed for successive Intervals. For example, a first Interval can include repeated injections at selected operational and cycle parameters. A second Interval will consist of repeated injection cycles at a second selected set of operational and cycle parameters.

As the process continues, at step 76, it is possible to optimize the waste disposal injection operations. For example, comparison can be made of data across Intervals. For example, the determined formation capacity, stress increments, or formation pressure increments can be compared. The comparison yields information as to which parameters effect total formation capacity, the degree of the effect, and predicted maximum capacities assuming selected parameter selections. In this way, waste disposal operations can be optimized to provide the greatest total waste disposal over the life of the operation. Similarly, operations can be optimized to provide the greatest economic advantage. Optimization is provided while insuring containment of waste in the target zone, within permit parameters, etc.

At step 78, operational instructions are provided to the field operation and the process continues utilizing the optimized operational and cycle parameters. For example, optimization may indicate a change in pump horsepower, pump flow rate, slurry parameters, cycle or batch sizes, cycle timing, rest periods, etc. The change is made at step 80, and another Interval is begun.

As the formation properties change over the life of the operation, for example, due to continued damage to the fracture faces, the process provides for repeated determinations of formation pressure and stress trends, formation capacities, etc., with continued optimization during the field life.

The above flow chart and steps are exemplary in nature. It is expressly understood that the process laid out in the steps above are not limited to only the particular order presented. Steps may be omitted, repeated, or rearranged.

CONCLUSION

The words or terms used herein have their plain, ordinary meaning in the field of this disclosure, except to the extent explicitly and clearly defined in this disclosure or unless the specific context otherwise requires a different meaning. If there is any conflict in the usages of a word or term in this disclosure and one or more patent(s) or other documents that may be incorporated by reference, the definitions that are consistent with this specification should be adopted.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

While the foregoing written description of the disclosure enables one of ordinary skill to make and use the embodiments discussed, those of ordinary skill will understand and appreciate the existence of variations, combinations, and equivalents of the specific embodiments, methods, and examples herein. The disclosure should therefore not be limited by the above described embodiments, methods, and examples. While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

The systems, methods, and apparatus in the embodiments described above are exemplary. Therefore, many details are neither shown nor described. Even though numerous characteristics of the embodiments of the present disclosure have been set forth in the foregoing description, together with details of the structure and function of the present disclosure, the present disclosure is illustrative, such that changes may be made in the detail, especially in matters of shape, size and arrangement of the components within the principles of the present disclosure to the full extent indicated by the broad general meaning of the terms used in the attached claims. The description and drawings of the specific examples above do not point out what an infringement of this patent would be, but are to provide at least one explanation of how to make and use the present disclosure. The limits of the embodiments of the present disclosure and the bounds of the patent protection are measured by and defined in the following claims.

It is claimed:

1. A method of hydraulic fracture injection into a target zone of a subterranean formation, the target zone bounded by an upper boundary zone, an injection wellbore extending through the target zone and upper boundary zone, the method comprising:

(a) pumping an initial cycle of waste slurry into the injection wellbore at selected initial cycle parameters and initial operational parameters;

(b) hydraulically fracturing the target zone and injecting the initial cycle of waste slurry into the fractured target zone;

(c) shutting-in the well for a duration less than the fracture closure time;

(d) performing a pressure fall-off test after shut-in of the well; and (e) pumping a subsequent cycle of waste slurry into the injection wellbore at selected subsequent cycle and operational parameters, the subsequent cycle or operational parameters modified from the initial cycle or operational parameters in response to determination of fracture closure pressure using an Instantaneous Shut-In Pressure (ISIP) determined from the fall-off test.

2. The method of claim 1, wherein the modified cycle or operational parameters are taken from the group comprising: cycle volume, cycle solids volume, cycle solids concentration, cycle slurry viscosity, cycle slurry density, cycle slurry particle size, cycle pump rate, cycle pumping duration, cycle pump pressure, cycle wellbore pressure, and cycle pump horsepower.

3. The method of claim 1, wherein step (e) further comprises, pumping a subsequent cycle of waste slurry into the injection wellbore at selected subsequent cycle and operational parameters in response to determination of fracture closure pressure using an ISIP and formation parameters.

4. The method of claim 3, wherein the formation parameters are taken from the group consisting of: permeability, porosity, pore pressure, formation stresses, Young's modulus of elasticity, Poisson's ratio, overburden pressure, toughness, and log data from gamma ray, porosity, bulk density, and compressional and shear sonic velocities logs.

5. The method of claim 3, wherein the formation parameters include at least three of permeability, porosity, pore pressure, formation stresses, Young's modulus of elasticity, Poisson's ratio, and overburden pressure.

6. The method of claim 1, wherein step (e) further comprises: pumping a subsequent cycle of waste slurry into the injection wellbore at selected subsequent cycle and operational parameters in response to determination of fracture closure pressure using an Instantaneous Shut-In Pressure (ISIP) determined from the fall-off test, the fracture closure pressure determined from an empirical equation relating fracture closure pressure and ISIP.

7. The method of claim 1, wherein step (e) further comprises: pumping a subsequent cycle of waste slurry into the injection wellbore at selected subsequent cycle and operational parameters in response to determination of fracture closure pressure using an Instantaneous Shut-In Pressure (ISIP) determined from the fall-off test, the fracture closure pressure determined from an empirical equation relating fracture closure pressure and ISIP and taking the form: $Pc=(C_1)(ISIP)+C_2$, where Pc is fracture closure pressure, and $C_1$ and $C_2$ are coefficients.

8. The method of claim 7, wherein the coefficients $C_1$ and $C_2$ are linear coefficients.

9. The method of claim 7, wherein the coefficient $C_1$ is $C_{1,K}$, where K is permeability.

10. The method of claim 7, wherein the coefficient $C_2$ is $C_2=(C_{2,E}+C_{2,v}+C_{2,P}+C_{2,s}+C_{2,\varphi})/5$.

11. The method of claim 7, wherein the coefficient $C_2$ is the average a plurality of $C_2$ coefficients for a plurality of formation parameters.

12. The method of claim 7, wherein the coefficient $C_2$ is the average of a plurality of $C_2$ coefficients for a plurality of formation parameters including at least three of porosity, pore pressure, formation stresses, Young's modulus of elasticity, Poisson's ratio, and overburden pressure.

13. The method of claim 7, wherein the generic formulae for $C_1$ and $C_2$ are: $C_1=C_{1,K}$ and $C_2=(C_{2,E}+C_{2,v}+C_{2,P}+C_{2,s}+C_{2,\varphi})/5$, where, $C_{1,K}=-0.0031K+0.8343$; $C_{2,E}=0.00005E+340.78$; $C_{2,v}=0.4435EXP(25.695v)$; $C_{2,P}=0.3139P+92.077$; $C_{2,s}=0.15335+37.046$; and $C_{2,\varphi}=(-13618)\varphi+3152$, where, K is formation permeability, E is Young's modulus, v is Poisson's ratio, P is formation pressure, s is overburden stress and φ is porosity.

14. The method of claim 1, wherein step (e) further comprises: pumping a subsequent cycle of waste slurry into the injection wellbore at selected subsequent cycle and operational parameters in response to determination of fracture closure pressure using an Instantaneous Shut-In Pressure (ISIP) determined from the fall-off test, the fracture closure pressure predicted from an empirical equation relating historical fracture closure pressure and ISIP data for the formation.

15. The method of claim 14, wherein the empirical equation relating historical fracture closure pressure and ISIP data for the formation utilizes linear regression fitting of the historical data.

16. The method of claim 1, wherein step (e) further comprises, pumping a subsequent cycle of waste slurry into the injection wellbore at selected subsequent cycle and operational parameters in response to determination of fracture closure pressure using an ISIP and formation parameters.

17. The method of claim 1, wherein step (e) further comprises, pumping a subsequent cycle of waste slurry into the injection wellbore at selected subsequent cycle and operational parameters in response to stress increment monitoring and formation capacity prediction utilizing fracture closure pressure determined using well ISIP data and formation parameters.

18. A method of fracture injecting waste slurry into a disposal well extending through a target zone, the method comprising:

(1) conducting a first set of injection cycles, each of the first set of injection cycles performed using a first set of cycle parameters and operational parameters within a selected range, each injection cycle injecting a volume of wastes into the zone, a cumulative total of wastes injected over the first set of injection cycles, the injection cycle for each of the first set of cycles comprising:

(a) pumping an injection cycle of waste slurry into the target zone of the disposal well within the selected range of the selected cycle parameters and operational parameters;

(b) hydraulically fracturing the target zone and injecting the cycle of waste slurry into the fractured target zone;

(c) shutting-in the well for a duration less than the fracture closure time;

(d) performing a pressure fall-off test after shut-in of the well;

(2) conducting a second set of injection cycles, each of the second set of injection cycles performed using a second set of cycle and operational parameters within a selected range, the second set of parameters different from the first set of parameters, the second set of parameters obtained from a determination of fracture closure pressures for the first set of injection cycles and predicted formation disposal capacity.

19. The method of claim 18, further comprising: (3) conducting a third set of injection cycles, each of the third set of injection cycles performed using a third set of cycle and operational parameters within a selected range, the third set of parameters different from the first and second set of parameters, the third set of parameters obtained from a determination of fracture closure pressures for the second set of injection cycles and predicted formation disposal capacity.

20. The method of claim 18, wherein the second set of cycle parameters differ from the first set of cycle parameters by a change in at least one of: cycle volume, solids volume, solids concentration, viscosity, density, or particle size.

21. The method of claim 18, wherein the second set of operational parameters differ from the first set of operational parameters by a change in at least one of: pump rate, pumping duration, pump pressure, wellbore pressure, or pump horsepower.

22. The method of claim 18, wherein the second set of parameters obtained from a determination of fracture closure pressures for the first set of injection cycles includes fracture closure pressures predicted using the ISIP Analysis Method.

23. The method of claim 18, wherein the second set of parameters obtained from a determination of fracture closure pressures for the first set of injection cycles includes fracture closure pressures predicted using the ISIP from the pressure fall-off tests.

24. The method of claim 18, wherein the second set of parameters obtained from a determination of fracture closure pressures for the first set of injection cycles are selected to optimize total disposal volume.

* * * * *